US009466451B2

(12) United States Patent
Carlino et al.

(10) Patent No.: US 9,466,451 B2
(45) Date of Patent: Oct. 11, 2016

(54) FLUX SHUNT TRIP ACTUATOR INTERFACE AND BREAKER RESET MECHANISM FOR CIRCUIT BREAKER

(71) Applicant: Eaton Corporation, Cleveland, OH (US)

(72) Inventors: Harry James Carlino, Export, PA (US); Lloyd Allen Maloney, Beaver, PA (US); Martha Suryani Bucchi, Wexford, PA (US); Mark Anthony Janusek, Bethel Park, PA (US)

(73) Assignee: EATON CORPORATION, Cleveland, OH (US)

( * ) Notice: Subject to any disclaimer, the term of this patent is extended or adjusted under 35 U.S.C. 154(b) by 215 days.

(21) Appl. No.: 14/103,871

(22) Filed: Dec. 12, 2013

(65) Prior Publication Data

US 2015/0170862 A1 Jun. 18, 2015

(51) Int. Cl.

| | |
|---|---|
| ***H01H 9/20*** | (2006.01) |
| ***H01H 50/64*** | (2006.01) |
| ***H01H 3/54*** | (2006.01) |
| ***H01H 50/18*** | (2006.01) |
| ***H01H 50/44*** | (2006.01) |
| ***H01H 50/54*** | (2006.01) |
| ***H01H 71/10*** | (2006.01) |
| *H01H 71/12* | (2006.01) |

(52) U.S. Cl.

CPC ..... *H01H 50/64* (2013.01); *H01H 3/54* (2013.01); *H01H 50/18* (2013.01); *H01H 50/44* (2013.01); *H01H 50/54* (2013.01); *H01H 71/1072* (2013.01); *H01H 2071/124* (2013.01)

(58) Field of Classification Search

CPC ..... H01H 3/54; H01H 50/18; H01H 50/44; H01H 50/64; H01H 71/1072; H01H 50/54; H01H 2071/124

USPC ..... 335/166

See application file for complete search history.

(56) References Cited

U.S. PATENT DOCUMENTS

| | | | |
|---|---|---|---|
| 5,093,643 | A | 3/1992 | Altenhof, Jr. et al. |
| 5,341,191 | A | 8/1994 | Crookston et al. |
| 5,475,386 | A | 12/1995 | Luoma |
| 6,853,279 | B1 | 2/2005 | Puskar et al. |
| 7,830,231 | B2 | 11/2010 | Carlino et al. |
| 7,911,298 | B2 | 3/2011 | Carlino et al. |
| 2006/0071740 | A1 | 4/2006 | Bogdon et al. |

FOREIGN PATENT DOCUMENTS

| | | |
|---|---|---|
| EP | 1 098 338 A2 | 5/2001 |
| EP | 1 503 396 A2 | 2/2005 |
| EP | 1 978 540 A2 | 10/2008 |

OTHER PUBLICATIONS

European Patent Office, "International Search Report and Written Opinion", Jan. 28, 2015, 13 pp.

*Primary Examiner* — Bernard Rojas
(74) *Attorney, Agent, or Firm* — Eckert Seamans Cherin & Mellott, LLC; David C. Jenkins; Grant E. Coffield

(57) ABSTRACT

A trip and reset assembly is provided. The trip and reset assembly includes a trip and reset actuator mounting and a trip and reset actuator. The trip and reset actuator is structured to move the plunger from the first position to the second position. The trip and reset actuator mounting includes a body defining a trip and reset actuator pivot coupling first component. The trip and reset actuator includes an elongated body with a pivot coupling second component, an actuator interface, a trip bar interface and a reset interface. The trip and reset actuator body is movably coupled to the trip and reset actuator mounting and is movable between a first position, wherein the trip bar interface engages the trip bar, and a second position, wherein the actuator interface engages the plunger.

17 Claims, 7 Drawing Sheets

FLUX SHUNT TRIP ACTUATOR INTERFACE AND BREAKER RESET MECHANISM FOR CIRCUIT BREAKER

BACKGROUND OF THE INVENTION

1. Field of the Invention

This invention relates generally to electrical switching apparatus and, more particularly, to trip actuator assemblies for circuit breakers.

2. Background Information

Electrical switching apparatus include, for example, circuit switching devices, circuit interrupters, such as circuit breakers, network protectors, contactors, motor starters, motor controllers, and other load controllers. Electrical switching apparatus such as circuit interrupters and, in particular, circuit breakers of the molded case variety, are well known in the art. See, for example, U.S. Pat. No. 5,341,191. Circuit breakers are used to protect electrical circuitry from damage due to an over-current condition, such as an overload condition or a relatively high level short circuit or fault condition. Molded case circuit breakers typically include a pair of separable contacts per phase. The separable contacts may be operated either manually by way of a handle disposed on the outside of the case or automatically in response to an over-current condition.

In an exemplary embodiment, circuit breakers include an operating mechanism, which is designed to rapidly open and close the separable contacts, a trip unit assembly, which senses over-current conditions, and a trip actuator assembly. The trip actuator is actuated by the trip unit assembly in response to an overcurrent condition and moves the operating mechanism to a trip state. In the trip state the separable contacts move to their open position.

Trip unit assemblies have often included mechanical devices that react magnetically or thermally to over-current conditions. Presently, electric circuits are also used to detect an over-current condition. As electric circuits do not react magnetically or thermally to over-current conditions, the electric circuit must be coupled to an electronic trip mechanism. For example, an electronic trip mechanism may be, without limitation, a flux shunt trip actuator. An electronic trip mechanism, such as, but not limited to, a flux shunt trip actuator needs a reset device. It is known to provide a separate reset actuator for a flux shunt trip actuator. That is, the reset actuator is separate from other elements such as, but not limited to, the circuit breaker handle.

There is, therefore, room for improvement in electrical switching apparatus, such as circuit breakers, and in trip actuator assemblies therefor.

SUMMARY OF THE INVENTION

At least one embodiment of this invention provides for a trip and reset assembly including a trip and reset actuator mounting and a trip and reset actuator. The trip and reset actuator is structured to move the plunger from the first position to the second position. The trip and reset actuator mounting includes a body defining a trip and reset actuator pivot coupling first component. The trip and reset actuator includes an elongated body with a pivot coupling second component, an actuator interface, a trip bar interface and a reset interface. The trip and reset actuator body is movably coupled to the trip and reset actuator mounting and is movable between a first position, wherein the trip bar interface engages the trip bar, and a second position, wherein the actuator interface engages the plunger.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
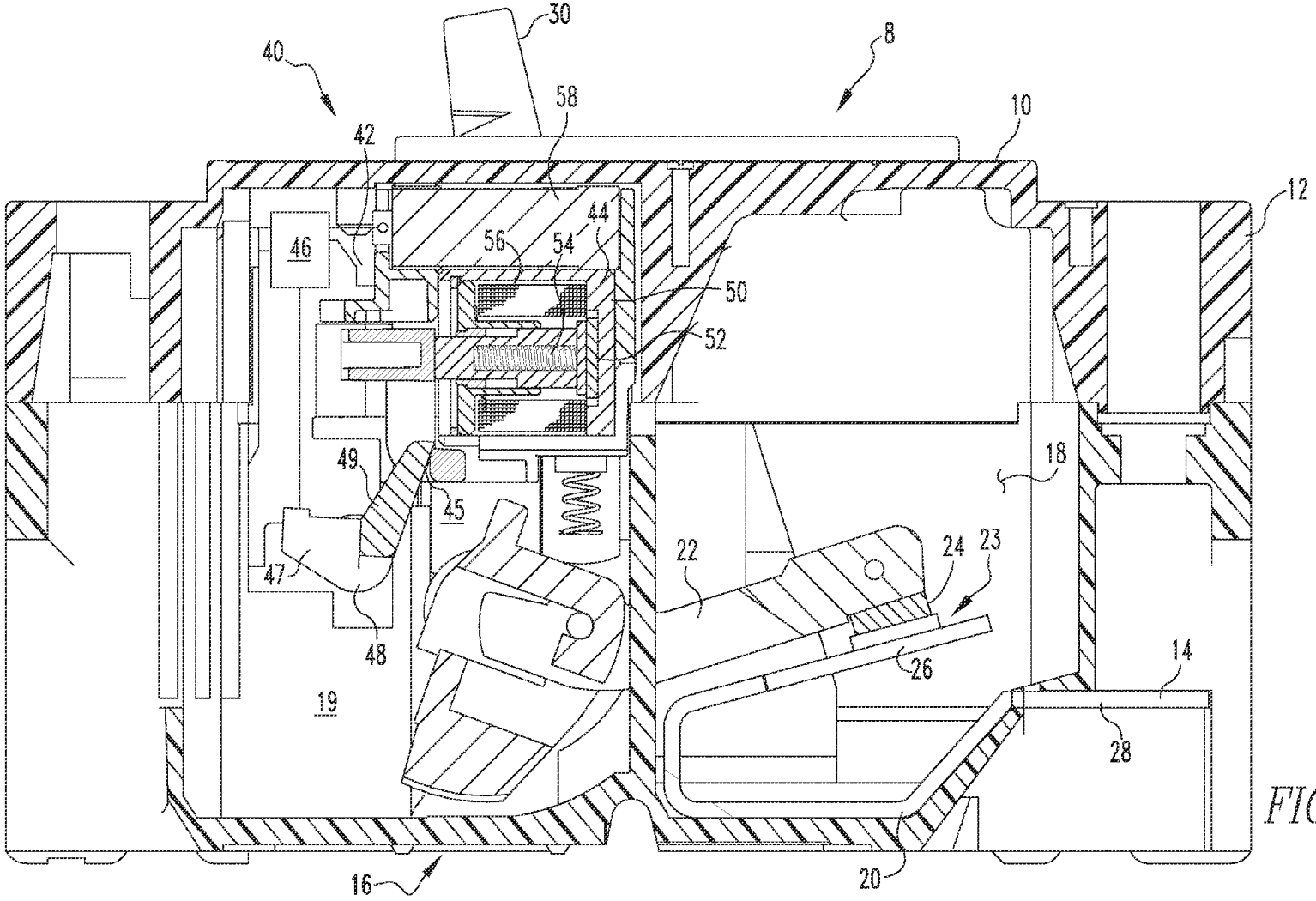
FIG. 1 is a cross-sectional side view of an electrical switching apparatus.
Figure 2:
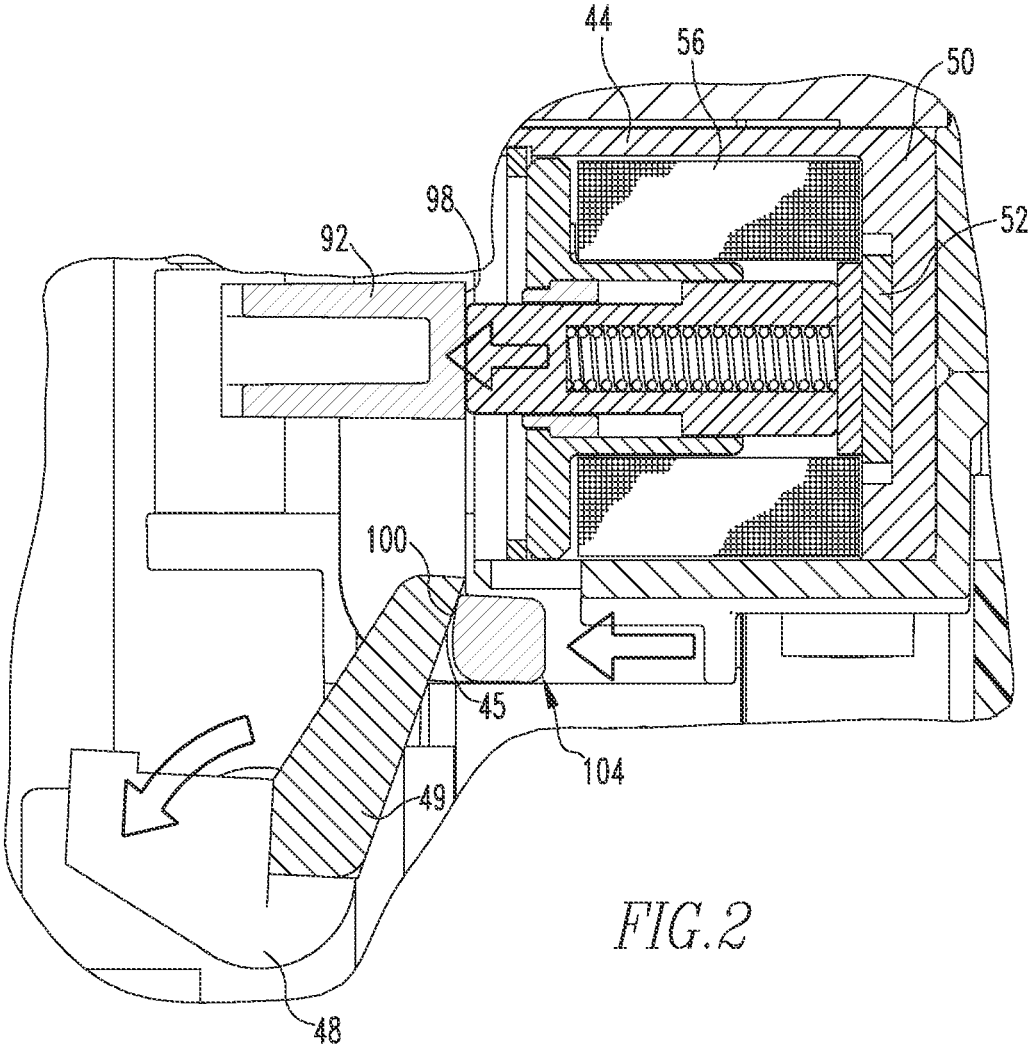
FIG. 2 is a detail cross-sectional side view of a trip and reset assembly.
Figure 3:
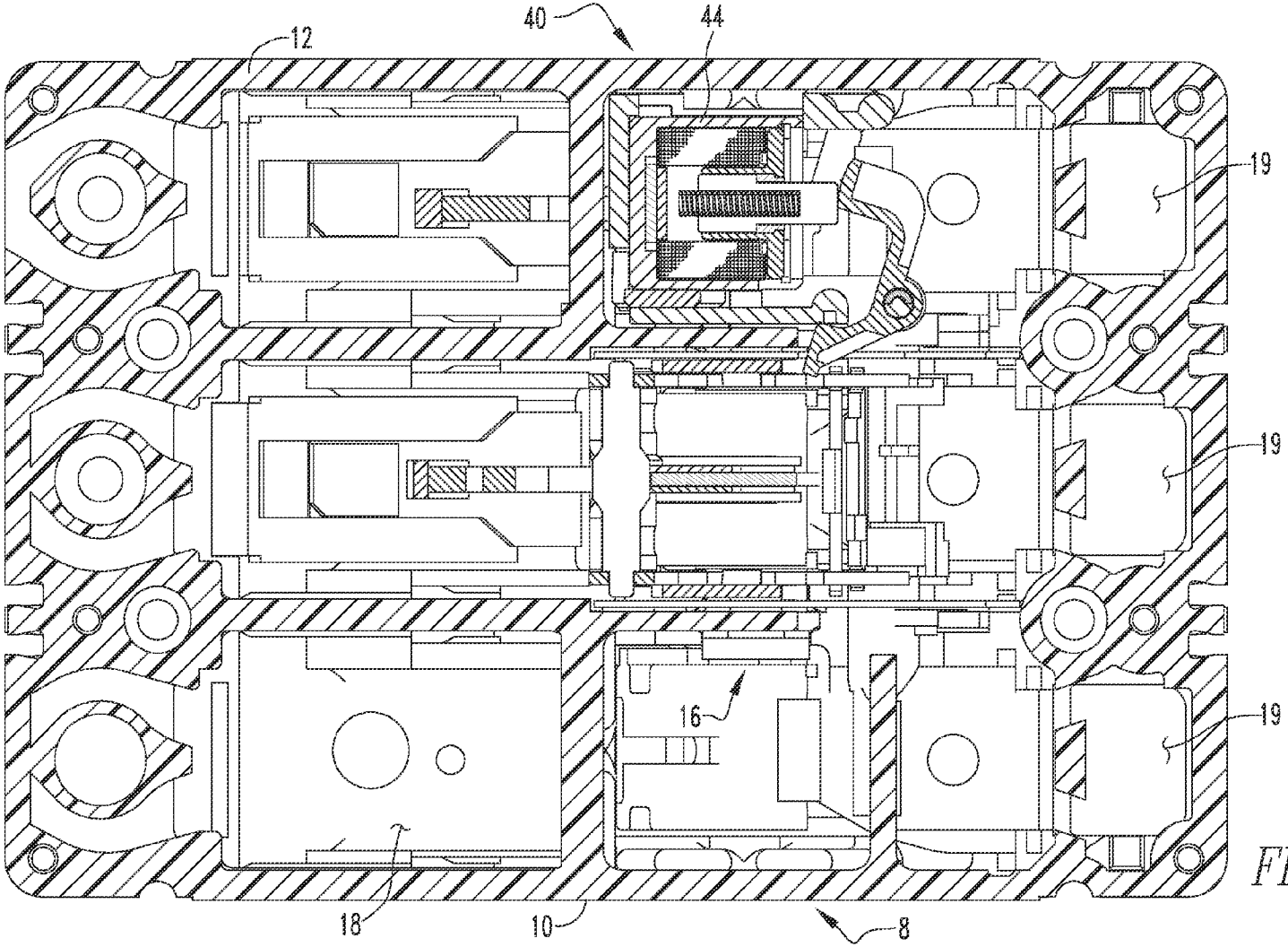
FIG. 3 is a cross-sectional top view of an electrical switching apparatus.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "actuator" and "actuating element" mean any known or suitable output mechanism (e.g., without limitation, trip actuator, solenoid, a flux shunt trip actuator) for an electrical switching apparatus and/or the element (e.g., without limitation, stem; plunger; lever; paddle; arm) of such mechanism which moves in order to manipulate another component of the electrical switching apparatus.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, a magnet "operatively spaced" from another element capable of magnetic attraction means that the two elements are so close as to allow the magnet to be attracted to the other element with a sufficient force so that, if the magnet or other element is not restrained, the magnet or other element would move into contact with each other.

As used herein, a "cam surface" is a surface that engages, or is engaged by, another member and wherein a member moves in response to the engagement. A surface that is merely capable of engaging, or being engaged by, another element but does not actually engage the other element is not a "cam surface."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening is made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit.

As used herein, a "first position" or "first configuration" is associated with an electrical switching apparatus in an open configuration, i.e. wherein electricity cannot pass through the electrical switching apparatus. Conversely, a "second position" or "second configuration" is associated with an electrical switching apparatus in a closed configuration, i.e. wherein electricity passes through the electrical switching apparatus. Thus, the "second position" or "second configuration" is associated with the operational state of the switching apparatus. Accordingly it is understood that when describing the operation of the switching apparatus, e.g. tripping in response to an over-current condition, the switching apparatus, or elements and assemblies thereof, may start in the "second position" and move to the "first position." It is further understood that when identifying an element "engaging" another element when in a selected position, the application of bias may occur during the movement into the identified position and/or when disposed in the indentified position.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true. For example, a trip bar may be "operatively coupled" to a circuit breaker operating mechanism, meaning that when the trip bar moves, so does the operating mechanism, but, the operating mechanism may not be "operatively coupled" to the trip bar, meaning that the operating mechanism may be manually operated, e.g. by a handle, without necessarily moving the trip bar.

As used herein, "generally curvilinear" includes elements having multiple curved portions, combinations of curved portions and planar portions, and a plurality of planar portions or segments disposed at angles relative to each other thereby forming a curve.

As shown in FIG. 1, and as is known, an electrical switching apparatus 8, such as, but not limited to a circuit breaker 10, includes an electrical switching apparatus housing assembly 12, a conductor assembly 14, an operating mechanism 16, a trip unit assembly 40, (elements shown schematically) as well as other components. The electrical switching apparatus housing assembly 12 is made from a non-conductive material and defines an enclosed space 18 wherein the other components may be disposed. The electrical switching apparatus housing assembly enclosed space 18 is, in an exemplary embodiment, divided into a number of cavities including a cavity 19 for a trip unit assembly actuator 44, described below.

The conductor assembly 14 includes a number of conductive elements 20 that extend through the electrical switching apparatus housing assembly 12. That is, a number of conductive elements 20 include, but are not limited to, a line bus 22, a pair of contacts 23 including a movable contact 24 and a fixed contact 26, and a load bus 28. As is known, there may be a number of sets of these elements, however, only one set will be described below. The line bus 22 and movable contact 24 are in electrical communication. The fixed contact 26 and the load bus 28 are in electrical communication. Each movable contact 24 is structured to move between an open, first position, wherein the movable contact 24 is spaced from the fixed contact 26, and, a closed, second position, wherein the movable contact 24 is directly coupled to, and in electrical communication with, the fixed contact 26.

Figure 4:
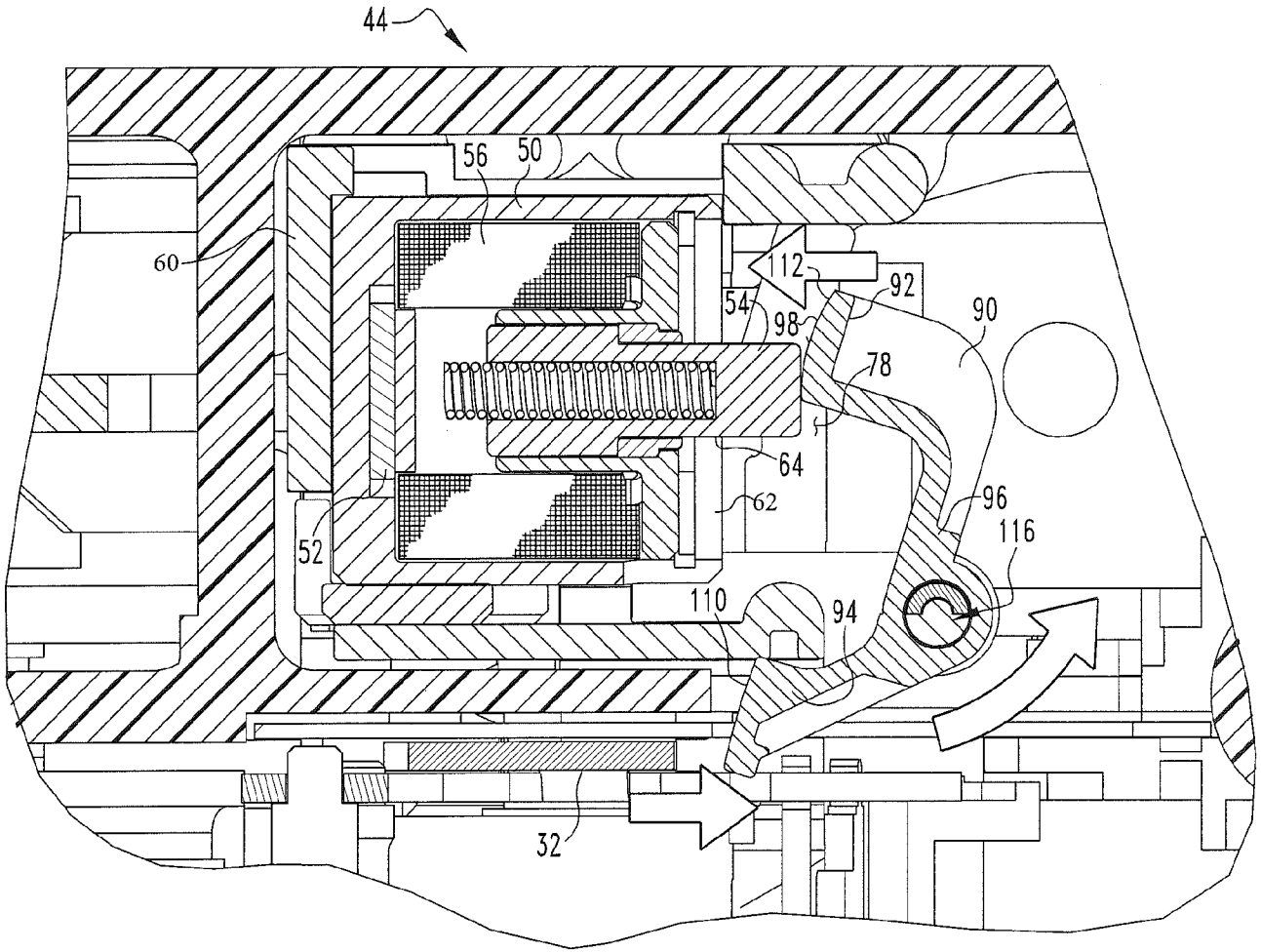
FIG. 4 is a detail cross-sectional top view of a trip and reset assembly.

The operating mechanism 16 is operatively coupled to each movable contact 24 and is structured to move each movable contact 24. The operating mechanism 16 moves between a number of configurations including an open, first configuration, wherein each movable contact 24 is spaced from an associated fixed contact 26, and, a closed, second configuration, wherein each movable contact 24 is directly coupled to, and in electrical communication with, the associated fixed contact 26. The operating mechanism 16 includes biasing elements (not shown) such as, but not limited to springs (not shown), that bias the operating mechanism 16 to the first configuration. Thus, the contacts 24, 26 are biased to the open, first position. The operating mechanism 16 includes a handle 30 and a reset member 32 (FIG. 4). The handle 30 may be used to move the contacts 24, 26 between the first and second positions. The handle 30 may also be moved to a reset position, thereby moving the operating mechanism 16 into a reset configuration. In an exemplary embodiment, the reset member 32 moves with the handle 30 and engages the trip and reset assembly 80 as described below.

The operating mechanism 16 further includes a catch (not shown), or similar device, that selectively prevents the operating mechanism 16 from moving to the first configuration. Thus, when the operating mechanism 16 is in the second configuration, wherein the pair of contacts 23 are in the closed position, the catch maintains the contacts 23 in the closed, second position. The catch, or more generally the operating mechanism 16 is mechanically coupled to the trip unit assembly 40, described below, by a trip latch (not shown). That is, the catch engages the trip latch. When the trip unit assembly 40 detects an over-current condition, a mechanical linkage causes the catch to be released from the trip latch thereby allowing the bias of the operating mechanism 16 to move the contacts 24, 26 to the open, first position. As is known, when the operating mechanism 16 is moved into the reset configuration, the catch reengages the trip latch before the operating mechanism 16 moves into the second position.

As shown in FIGS. 1-4, the trip unit assembly 40 includes a number of components such as, but not limited to, a number of electrical buses 42, a trip actuator assembly 44, a trip circuit 46, a trip bar 48, a housing assembly 70, and a trip and reset assembly 80. As is known, the trip circuit 46 is structured to detect an over-current condition in any of the electrical buses 42. The trip circuit 46 produces an electronic signal upon detecting an over-current condition in any of the electrical buses 42. The trip actuator assembly 44 is an electro-mechanical device that is in electronic communication with the trip circuit 46 and which is structured to produce a mechanical motion in response to receiving a signal indication and over-current condition in any of the electrical buses 42, as described below.

The trip bar 48 includes an elongated body 47. The longitudinal axis of the trip bar body 47 is also an axis of rotation. The trip bar 48 is movably coupled, and in an exemplary embodiment rotatably coupled, to the electrical switching apparatus housing assembly 12. The trip bar body 47 includes a number of engagement surfaces 45 including, but not limited to, radial extensions 49. As noted above, the trip bar 48 is operatively coupled to the operating mechanism 16 so that rotation of the trip bar 48 causes the operating mechanism 16 to move from the operating mechanism 16 second configuration to the operating mechanism 16 first configuration. That is, the trip bar 48 moves between a number of positions including a trip bar first position, wherein the catch does not engage the trip latch allowing the operating mechanism 16 to move to the operating mechanism 16 first configuration, and a trip bar second position, wherein the catch engages the trip latch thereby maintaining the operating mechanism 16 in the operating mechanism 16 second configuration.

The trip circuit 46 (shown schematically) is disposed in the electrical switching apparatus housing assembly 12 and coupled to the conductive elements 20 so as to detect an over-current condition, as is known. The trip circuit 46 is coupled to, and in electronic communication with the trip unit actuator assembly 44 via the number of electrical buses 42. Thus, the entire trip unit assembly 40 is disposed within the electrical switching apparatus housing assembly 12.

The trip unit actuator assembly 44 is structured to be actuated in response to receiving an electronic signal from the trip circuit 46. That is, the trip unit actuator assembly 44 is structured to receive an electronic signal from the trip circuit 46 and, in response thereto, to actuate a plunger 54 as described below. In an exemplary embodiment, the trip unit actuator assembly 44 is a flux shunt trip actuator that includes a housing 50, a permanent magnet 52, an elongated actuator member or plunger 54, a coil 56 and an energizing circuit 58 (shown schematically). The trip unit actuator assembly housing 50 includes a first end 60 and a second end 62. The trip actuator assembly housing second end 62 includes an opening 64 corresponding to the cross-sectional shape of the plunger 54. The permanent magnet 52 is disposed in the trip unit actuator assembly housing 50 at the trip unit actuator assembly housing first end 60. The plunger 54 is movably disposed in the trip unit actuator assembly housing 50 and moves axially between a plunger first, extended position, wherein the plunger 54 engages the trip bar 48 and moves the trip bar 48 into the trip bar first position, and a plunger second, retracted position, wherein the plunger 54 is spaced from the trip bar 48. A portion, or end, of the plunger 54 extends through the trip unit actuator assembly housing second end opening 64. The plunger 54 is made from a magnetically sensitive material, e.g. a ferrous material or a magnetic material. Thus, when the plunger 54 is in the plunger first position it is operatively spaced from the permanent magnet 52. That is, when the plunger 54 is in the first position, the permanent magnet 52 does not have sufficient force to attract, i.e. cause movement of, the plunger 54. When the plunger 54 is in the plunger second position, the plunger 54 is not operatively spaced from the permanent magnet 52. That is, when the plunger 54 is in the second position, the permanent magnet 52 has sufficient force to attract the plunger 54; thus, the plunger 54 is maintained in the plunger second position.

The coil 56 is disposed in the trip unit actuator assembly housing 50 and disposed about the plunger 54. The coil 56 is, in an exemplary embodiment, energized by the energizing circuit 58 and thereby creates a magnetic field. That is, the energizing circuit 58 is coupled to, and in electrical communication with, the coil 56. The magnetic field created by the coil 56 is sufficiently strong to overcome the magnetic attraction between the permanent magnet 52 and the plunger 54. Thus, when the coil 56 is energized, the plunger 54 moves to the first position. It is noted that in the first position, the plunger 54 is beyond the range of the permanent magnet 52. That is, the plunger 54 is more than operatively spaced from the permanent magnet 52. Thus, when the plunger 54 moves to the first position, it remains there until acted upon by an external force. Further, it is noted that because of the configuration of the trip and reset assembly 80, described below, the energy required to energize the coil 56 is reduced relative to other trip and reset configurations. Further, it is noted that because of the configuration of the trip and reset assembly 80, described below, the energy required to energize the coil 56 is reduced relative to other trip and reset configurations.

That is, the energizing circuit 58 charges a capacitor to a regulated voltage determined by circuit components (none shown). The value of the regulated voltage stored by the capacitor is determined by the voltage needed by the trip unit actuator assembly 44 in order to trip the circuit breaker 10. Harvesting technology has a limited ability to charge the capacitor to the proper voltage that is required by known trip actuator assemblies. Therefore, the trip unit actuator assembly 44 is structured to trip at a much lower voltage than previous trip actuator assemblies. For example, known trip unit actuators required the capacitor to be charged to about 41 volts. In an exemplary embodiment, the trip unit actuator assembly 44 is structured to trip at a capacitor charge of between about 22 volts and 28 volts, or about 25 volts.

Figure 5:
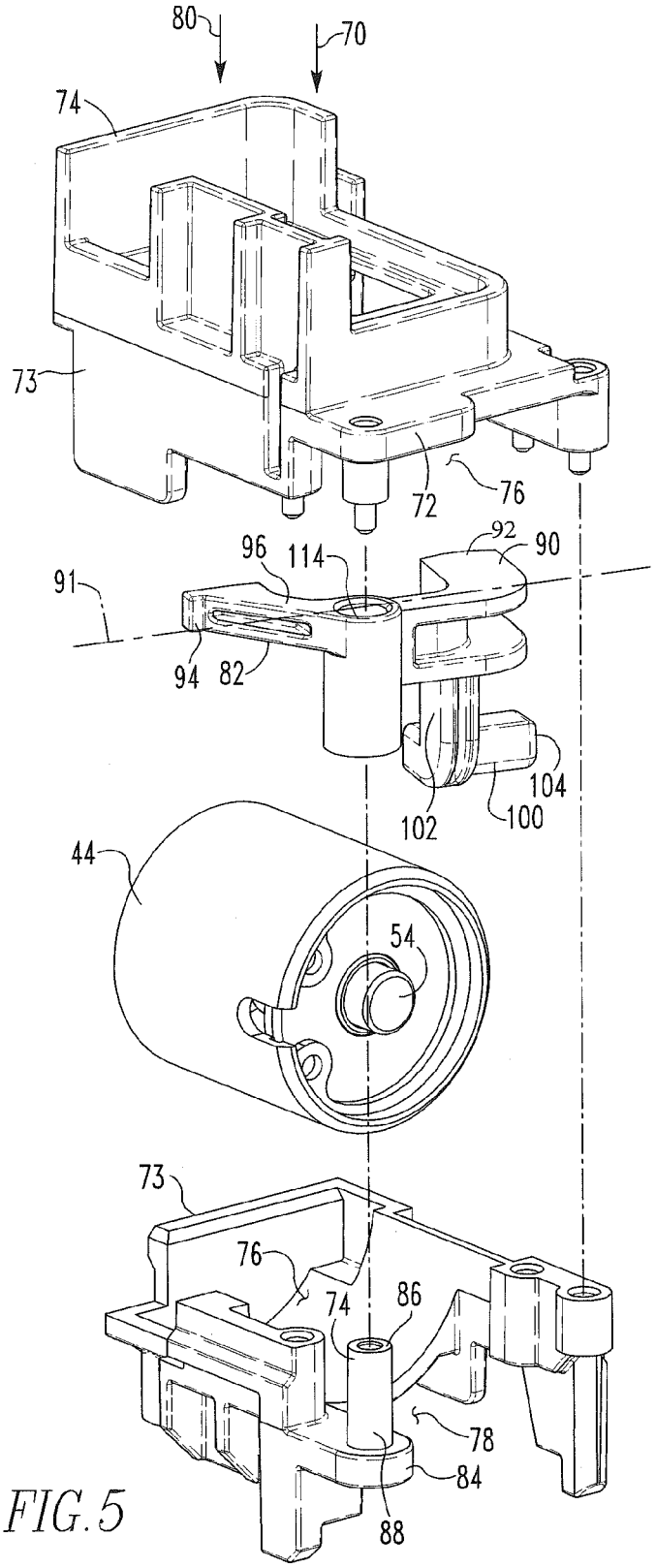
FIG. 5 is an exploded isometric view of a trip and reset assembly.
Figure 6:
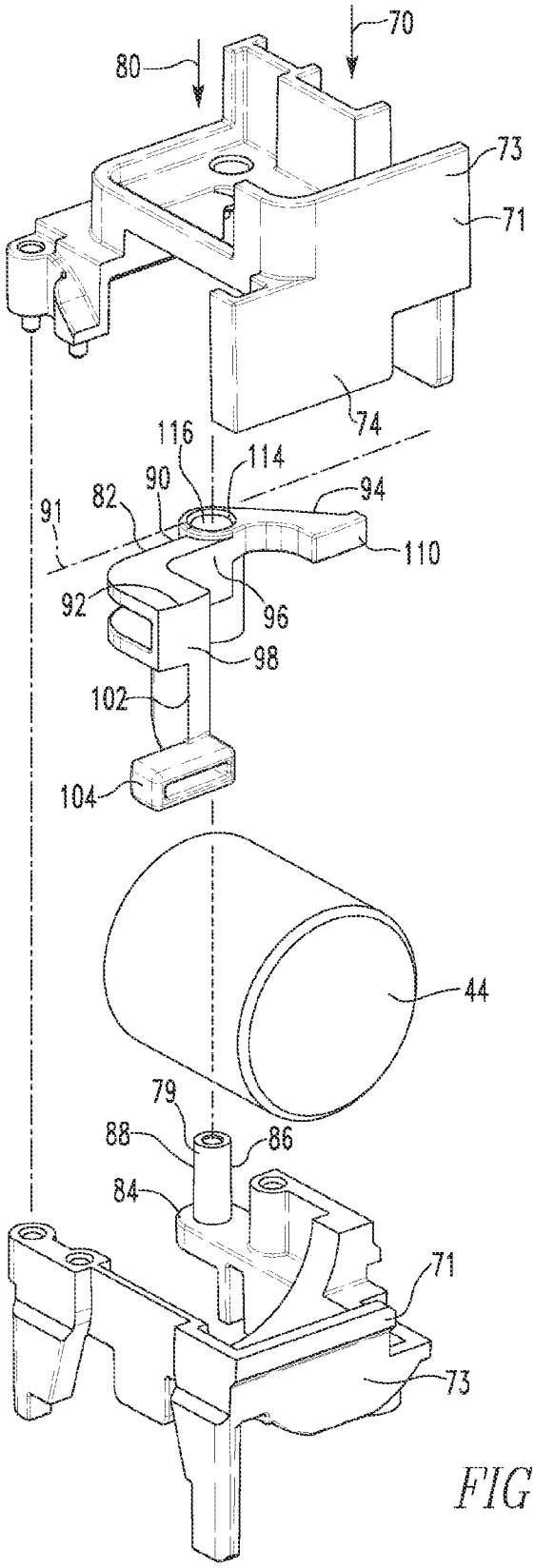
FIG. 6 is another exploded isometric view of a trip and reset assembly.
Figure 7:
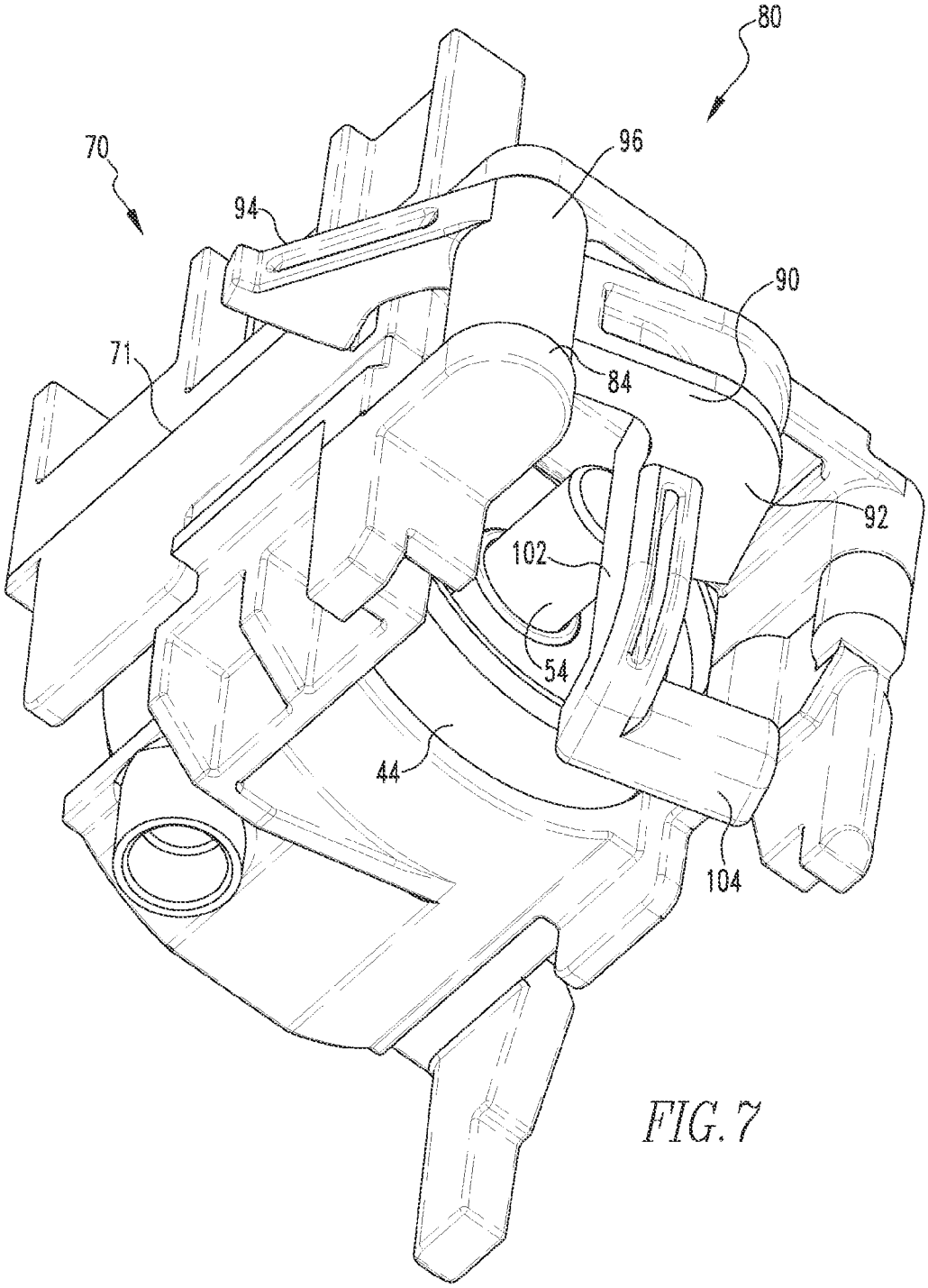
FIG. 7 is an isometric view of a trip and reset assembly.

The trip unit assembly housing assembly 70 includes a body 71 having a first end 72 and an opposing second end 74. As shown, the trip unit assembly housing assembly 70 is separate from the electrical switching apparatus housing assembly 12. Further, as shown, the trip unit assembly housing assembly body 71 includes a number of components 73 that are coupled to form the trip unit assembly housing assembly 70. In an alternate embodiment, not shown, the trip unit assembly housing assembly 70, or a portion of the is unitary with the electrical switching apparatus housing assembly 12. The trip unit assembly housing assembly body 71 defines a cavity 76 that generally corresponds with the size and shape of the trip unit actuator assembly 44. The trip unit assembly housing assembly body 71 includes a plunger opening 78 positioned to be aligned with the plunger 54 when the trip unit actuator assembly 44 is disposed in the trip unit assembly housing assembly 70. As shown in FIGS. 5-7, the trip and reset assembly 80 includes an actuator 82 and an actuator mounting 84. In an exemplary embodiment, the trip and reset actuator mounting 84 is unitary with the trip unit assembly housing assembly 70. That is, the trip and reset actuator mounting 84 is unitary with one of the trip unit assembly housing assembly body number of components 73. The trip and reset actuator mounting 84 includes a body 86 defining a reset actuator pivot coupling first component 88. As shown, the trip and reset actuator mounting pivot coupling first component 88 is a generally cylindrical member 79.

The trip and reset actuator 82 includes an elongated body 90 having a longitudinal axis 91, a first end 92, a second end 94 and a medial portion 96 therebetween. The trip and reset actuator body first end 92 includes an actuator interface 98 and a trip bar interface 100. In an exemplary embodiment, the trip and reset actuator body first end 92 includes an elongated extension 102 with a tab 104. The trip and reset actuator body extension 102 extends generally perpendicular to the trip and reset actuator body longitudinal axis 91. Further, the trip and reset actuator body tab 104 extends generally parallel to the trip and reset actuator body longitudinal axis 91. That is, the trip and reset actuator body tab 104 extends generally perpendicular to the trip and reset actuator body extension 102. In an exemplary embodiment, the actuator interface 98 is a surface of the trip and reset actuator body 90 and the trip bar interface 100 is a surface of the trip and reset actuator body tab 104. In an exemplary embodiment, the actuator interface 98 and the trip bar interface 100 are generally planar surfaces that are disposed generally in the same plane. The actuator interface 98 is structured to be engaged by and to engage the plunger 54, as described below. The trip bar interface 100 is structured to engage a trip bar body radial extensions 49.

The trip and reset actuator body second end 94 includes a reset interface 110. In an exemplary embodiment, the reset interface 110 is a generally curvilinear cam surface 112. The trip and reset actuator body 90 includes a pivot coupling second component 114. In an exemplary embodiment, the trip and reset actuator body pivot coupling second component 114 is a passage 116 having a generally circular cross-section. The trip and reset actuator body pivot coupling second component passage 116 corresponds to the trip and reset actuator mounting pivot coupling first component 88. It is noted that, in this configuration, the actuator interface 98/the trip bar interface 100 and the reset interface 110 are disposed on opposite sides of the trip and reset actuator body pivot coupling second component 114 and, therefore, when the trip and reset actuator body 90 moves, the trip bar interface 98 and the reset interface 110 move in opposite directions. In an exemplary embodiment, the trip and reset actuator body 90 is a unitary body. That is, as used herein, when the trip and reset actuator body 90 is a "unitary body," there is not a separate trip actuator and reset actuator.

The elements described above are assembled as follows. The trip unit actuator assembly 44 is disposed in the trip unit assembly housing assembly 70 with the plunger 54 aligned with the trip unit assembly housing assembly plunger opening 78. As described above, in this configuration, one end of the plunger 54 will extend through the trip unit assembly housing assembly plunger opening 78 when the plunger 54 is in the plunger first position.

The trip and reset actuator body 90 is coupled to the trip and reset actuator mounting 84. That is, the trip and reset actuator body pivot coupling second component 114 is coupled to the reset actuator pivot coupling first component 88 thereby pivotally coupling the trip and reset actuator body 90 to the trip and reset actuator mounting 84. In this configuration, the trip and reset actuator body first end 92 and, as shown in FIG. 4, the actuator interface 98 is disposed adjacent the trip unit assembly housing assembly plunger opening 78. Thus, when the plunger 54 moves into the plunger first position, the plunger 54 engages the actuator interface 98.

The trip and reset assembly 80 is then disposed in the electrical switching apparatus housing assembly 12 adjacent the operating mechanism 16 and the trip bar 48. That is, the trip bar interface 100 is disposed immediately adjacent the trip bar 48 and, in an exemplary embodiment, immediately adjacent or in contact with a trip bar body radial extensions 49. Further, the reset interface 110 is disposed adjacent the reset member 32.

The trip and reset actuator body 90 is movably, and in an exemplary embodiment pivotally, coupled to the trip and reset actuator mounting 84 and is movable between a first position, wherein the trip bar interface 100 engages the trip bar 48, and a second position, wherein the actuator interface 98 engages the plunger 54. Further, when the operating mechanism 16 is in the first or second configurations, the reset member 32 is spaced from the trip and reset actuator body 90. When the operating mechanism 16 moves into the reset configuration, the reset member 32 engages the reset interface 110.

In this configuration, the trip and reset assembly 80 operates as follows. For this description, it is assumed that the electrical switching apparatus 8 is in the closed position and operating. That is, each movable contact 24 is in the closed, second position, wherein each movable contact 24 is directly coupled to, and in electrical communication with, a fixed contact 26, the operating mechanism 16 is in the second configuration, the trip bar 48 is in the trip bar first position, the plunger 54 is in the plunger second, refracted position; and the trip and reset actuator body 90 is in the trip and reset actuator body second position. Upon detection of an over-current condition by the trip circuit 46, the trip actuator assembly 44 is actuated thereby moving the plunger 54 to the plunger first position. As the plunger 54 moves into the plunger first position, the plunger 54 engages the actuator interface 98 thereby moving the trip and reset actuator body 90 from the second position to the first position. As the trip and reset actuator body 90 moves from the second position to the first position, the trip bar interface 100 engages the trip bar 48 thereby moving the trip bar 48 from the trip bar second position to the trip bar first position. As described above, rotation of the trip bar 48 causes the operating mechanism 16 to move from the operating mechanism 16 second configuration to the operating mechanism 16 first configuration. As further described above, movement of the operating mechanism 16 into the first configuration separates the pair of contacts 23.

Further, when the operating mechanism 16 is moved from the first configuration to the reset configuration, the reset member 32 engages the reset interface 110. When the reset interface 110 is engaged, the trip and reset actuator body 90 moves back to the second position. As the trip and reset actuator body 90 moves back to the second position, the actuator interface 98 engages the plunger 54 and moves the plunger 54 to the plunger second position. As noted above, movement of the operating mechanism 16 from the first configuration to the reset configuration also repositions the trip bar 48 in the second position.

Accordingly, when the plunger 54 moves into the plunger first position, the plunger 54 engages the actuator interface 98 and moves the trip and reset actuator body 90 into the trip and reset actuator body first position, and, when the trip and reset actuator body 90 moves into the trip and reset actuator body first position, the trip bar interface 100 engages the trip bar 48 and moves the trip bar 48 to the trip bar first position. Further, when the operating mechanism 16 moves into the reset configuration, the reset member 32 engages the reset interface 110 and moves the trip and reset actuator body 82 into the trip and reset actuator body second position, and, when the trip and reset actuator body 90 moves into the trip and reset actuator body second position, the actuator interface 98 engages the plunger 54 and moves the plunger 54 into the plunger second position. Further, when the operating mechanism 16 moves to the reset configuration, the reset member 32 engages the reset interface 110 and moves the trip and reset actuator body 82 to the trip and reset actuator body second position.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

Further, as used herein, any element initially identified in a claim's preamble is not a claim element even if such element is later recited in the claim. That is, the claims may recite a number of unclaimed elements in the preamble and later recite a relationship or an interaction between the unclaimed elements set forth in the preamble and the claimed elements. It is understood that even though the elements initially recited in the preamble are later recited in the body of the claim, those elements, i.e. the unclaimed elements identified in the preamble, are not claimed elements. For example, a claim for the trip and reset assembly 70 only claims the elements of the trip and reset assembly 70; the claim preamble, however, identifies a number of elements, such as but not limited to the operating mechanism 16. It is understood that a claim recitation describing the interaction of the trip and reset assembly 70 with the operating mechanism 16, i.e. the unclaimed elements identified in the preamble, does not claim the unclaimed elements identified in the preamble which, in this example, are the elements of the operating mechanism 16.

What is claimed is:

1. A trip and reset assembly for a trip unit assembly of an electrical switching apparatus, said electrical switching apparatus including an operating mechanism, said operating mechanism including a reset member, said trip unit assembly including a housing assembly, a trip bar and a trip actuator assembly with a plunger, said trip bar structured to move between a first position and a second position, said plunger structured to move axially between a first, extended position and a second retracted position, wherein, when said plunger moves to said plunger first extended position said plunger engages said trip bar and moves said trip bar into said trip bar first position, said trip actuator assembly structured to move said plunger in one direction, said trip and reset assembly comprising:

a trip and reset actuator mounting;

a trip and reset actuator, said trip and reset actuator disposed adjacent said operating mechanism reset member;

said trip and reset actuator structured to move said plunger from said first position to said second position;

said trip and reset actuator mounting including a body defining a trip and reset actuator pivot coupling first component;

said trip and reset actuator including an elongated body with a pivot coupling second component, an actuator interface, a trip bar interface and a reset interface;

said trip and reset actuator body movably coupled to said trip and reset actuator mounting and movable between a first position, wherein said trip bar interface engages said trip bar, and a second position, wherein said actuator interface engages said plunger;

said trip and reset actuator body includes a first end, a medial portion and a second end;

said trip bar interface disposed at said trip and reset actuator body first end;

said pivot coupling second component disposed at said trip and reset actuator body medial portion; and said reset interface disposed at said trip and reset actuator body second end, said reset interface is structured to engage said operating mechanism reset member.

2. The trip and reset assembly of claim 1 wherein said trip and reset actuator body is pivotally coupled to said trip and reset actuator mounting.

3. The trip and reset assembly of claim 1 wherein said trip and reset actuator mounting body is unitary with said trip unit assembly housing assembly.

4. The trip and reset assembly of claim 1 wherein said trip bar interface is a generally curvilinear cam surface.

5. The trip and reset assembly of claim 1 wherein:

said trip actuator includes a coil and an energizing circuit;

said coil disposed substantially about said plunger when said plunger is in said second position;

said energizing circuit coupled to, and in electrical communication with, said coil; and said energizing circuit structured to store a charge of between about 22 volts and 28 volts.

6. The trip and reset assembly of claim 1 wherein said trip and reset actuator is a unitary body.

7. The trip and reset assembly of claim 1 wherein said electrical switching apparatus operating mechanism includes a number of fixed contacts and a number of movable contacts, said operating mechanism operatively coupled to each movable contact and structured to move each movable contact, wherein each said movable contact is movable between an open, first position, wherein the movable contact is spaced from a fixed contact, and, a closed, second position, wherein the movable contact is directly coupled to, and in electrical communication with, a fixed contact, wherein said operating mechanism is movable between three configurations, a first configuration, wherein each movable contact is spaced from a fixed contact, a closed, second configuration, wherein each movable contact is directly coupled to, and in electrical communication with, a fixed contact and wherein said operating mechanism is biased toward said first configuration, and a reset configuration, and wherein:

when said operating mechanism moves to said reset configuration, said operating mechanism reset member engages said reset actuator body reset interface;

wherein, when said plunger moves into said plunger first position, said plunger engages said actuator interface and moves said trip and reset actuator body into said trip and reset actuator body first position, and, when said trip and reset actuator body moves into said trip and reset actuator body first position, said trip bar interface engages said trip bar and moves said trip bar to said trip bar first position; and wherein when said operating mechanism moves into said reset configuration, said operating mechanism reset member engages said reset interface and moves said trip and reset actuator body into said trip and reset actuator body second position, and, when said trip and reset actuator body moves into said trip and reset actuator body second position, said actuator interface engages said plunger and moves said plunger into said plunger second position.

8. A trip unit assembly for an electrical switching apparatus, wherein said electrical switching apparatus includes an operating mechanism, a number of fixed contacts and a number of movable contacts, said operating mechanism including a reset member, said operating mechanism operatively coupled to each movable contact and structured to move each movable contact, wherein each said movable contact is movable between an open, first position, wherein the movable contact is spaced from a fixed contact, and, a closed, second position, wherein the movable contact is directly coupled to, and in electrical communication with, a fixed contact, wherein said operating mechanism is movable between three configurations, a first configuration, wherein each movable contact is spaced from a fixed contact, a closed, second configuration, wherein each movable contact is directly coupled to, and in electrical communication with, a fixed contact and wherein said operating mechanism is biased toward said first configuration, and a reset configuration, said trip unit assembly comprising:

a housing assembly defining a cavity;

a trip bar, said trip bar operatively coupled to said operating mechanism, said trip bar movable between a first position, wherein said trip bar does not restrain the movement of said operating mechanism, and a second position, wherein said trip bar restrains the movement of said operating mechanism;

a trip actuator assembly including a plunger, said plunger structured to move axially between a first, extended position and a second retracted position, wherein, when said plunger moves to said plunger first extended position said plunger engages said trip bar and moves said trip bar into said trip bar first position, said trip actuator assembly structured to move said plunger from said plunger second position to said plunger first position;

a trip and reset assembly including a trip and reset actuator mounting and a trip and reset actuator, said trip and reset assembly structured to move said plunger from said first position to said second position;

said trip and reset actuator mounting including a body defining a reset actuator pivot coupling first component;

said trip and reset actuator including an elongated body with a pivot coupling second component, an actuator interface, a trip bar interface and a reset interface;

said trip and reset actuator disposed adjacent said operating mechanism reset member;

said trip and reset actuator body movably coupled to said trip and reset actuator mounting and movable between a first position, wherein said trip bar interface engages said trip bar, and a second position, wherein said actuator interface engages said plunger;

said trip and reset actuator body includes a first end, a medial portion and a second end;

said trip bar interface disposed at said trip and reset actuator body first end;

said pivot coupling second component disposed at said trip and reset actuator body medial portion; and said reset interface disposed at said trip and reset actuator body second end.

9. The trip unit assembly of claim 8 wherein said trip and reset actuator body is pivotally coupled to said trip and reset actuator mounting.

10. The trip unit assembly of claim 8 wherein said trip and reset actuator mounting body is unitary with said trip unit assembly housing assembly.

11. The trip unit assembly of claim 8 wherein:

said trip actuator includes a coil and an energizing circuit;

said coil disposed substantially about said plunger when said plunger is in said second position;

said energizing circuit coupled to, and in electrical communication with, said coil; and said energizing circuit structured to store a charge of between about 22 volts and 28 volts.

12. The trip unit assembly of claim 8 wherein said trip and reset actuator is a unitary body.

13. The trip unit assembly of claim 8 wherein:

when said operating mechanism moves to said reset configuration, said operating mechanism reset member engages said reset actuator body reset interface;

wherein, when said plunger moves into said plunger first position, said plunger engages said actuator interface and moves said trip and reset actuator body into said trip and reset actuator body first position, and, when said trip and reset actuator body moves into said trip and reset actuator body first position, said trip bar interface engages said trip bar and moves said trip bar to said trip bar first position; and wherein when said operating mechanism moves into said reset configuration, said operating mechanism reset member engages said reset interface and moves said trip and reset actuator body into said trip and reset actuator body second position, and, when said trip and reset actuator body moves into said trip and reset actuator body second position, said actuator interface engages said plunger and moves said plunger into said plunger second position.

14. An electrical switching apparatus comprising:

a number of fixed contacts and a number of movable contacts, wherein each said movable contact is movable between an open, first position, wherein the movable contact is spaced from a fixed contact, and, a closed, second position, wherein the movable contact is directly coupled to, and in electrical communication with, a fixed contact;

said operating mechanism including a reset member, said operating mechanism operatively coupled to each movable contact and structured to move each movable contact, wherein each said movable contact is movable between an open, first position, wherein the movable contact is spaced from a fixed contact, and, a closed, second position, wherein the movable contact is directly coupled to, and in electrical communication with, a fixed contact, wherein said operating mechanism is movable between three configurations, a first configuration, wherein each movable contact is spaced from a fixed contact, a closed, second configuration, wherein each movable contact is directly coupled to, and in electrical communication with, a fixed contact and wherein said operating mechanism is biased toward said first configuration, and a reset configuration;

a trip unit assembly including a housing assembly, a trip actuator assembly and a trip bar;

said trip unit assembly housing assembly defining a cavity;

said trip bar operatively coupled to said operating mechanism, said trip bar movable between a first position, wherein said trip bar does not restrain the movement of said operating mechanism, and a second position, wherein said trip bar restrains the movement of said operating mechanism;

said trip actuator assembly including a plunger, said plunger structured to move axially between a first, extended position and a second retracted position, wherein, when said plunger moves to said plunger first extended position said plunger engages said trip bar and moves said trip bar into said trip bar first position, said trip actuator assembly structured to move said plunger from said plunger second position to said plunger first position;

a trip and reset assembly including a trip and reset actuator mounting and a trip and reset actuator, said trip and reset assembly structured to move said plunger from said first position to said second position;

said trip and reset actuator mounting including a body defining a reset actuator pivot coupling first component;

said trip and reset actuator including an elongated body with a pivot coupling second component, an actuator interface, a trip bar interface and a reset interface;

said trip and reset actuator body movably coupled to said trip and reset actuator mounting and movable between a first position, wherein said trip bar interface engages said trip bar, and a second position, wherein said actuator interface engages said plunger;

when said operating mechanism moves to said reset configuration, said operating mechanism reset member engages said reset actuator body reset interface;

wherein, when said plunger moves into said plunger first position, said plunger engages said actuator interface and moves said trip and reset actuator body into said trip and reset actuator body first position, and, when said trip and reset actuator body moves into said trip and reset actuator body first position, said trip bar interface engages said trip bar and moves said trip bar to said trip bar first position;

wherein, when said operating mechanism moves into said reset configuration, said operating mechanism reset member engages said reset interface and moves said trip and reset actuator body into said trip and reset actuator body second position, and, when said trip and reset actuator body moves into said trip and reset actuator body second position, said actuator interface engages said plunger and moves said plunger into said plunger second position;

said trip and reset actuator body includes a first end, a medial portion and a second end;

said trip bar interface disposed at said trip and reset actuator body first end;

said pivot coupling second component disposed at said trip and reset actuator body medial portion; and said reset interface disposed at said trip and reset actuator body second end.

15. The electrical switching apparatus of claim 14 wherein said trip and reset actuator body is pivotally coupled to said trip and reset actuator mounting.

16. The electrical switching apparatus of claim 14 wherein said trip and reset actuator mounting body is unitary with said trip unit assembly housing assembly.

17. The electrical switching apparatus of claim 14 wherein:

said trip actuator includes a coil and an energizing circuit;

said coil disposed substantially about said plunger when said plunger is in said second position;

said energizing circuit coupled to, and in electrical communication with, said coil; and said energizing circuit structured to store a charge of between about 22 volts and 28 volts.

* * * * *